United States Patent [19]

Smith et al.

[11] Patent Number: 5,073,713

[45] Date of Patent: Dec. 17, 1991

[54] DETECTION METHOD FOR DISSOCIATION OF MULTIPLE-CHARGED IONS

[75] Inventors: Richard D. Smith; Harold R. Udseth; Alan L. Rockwood, all of Richland, Wash.

[73] Assignee: Battelle Memorial Institute, Richland, Wash.

[21] Appl. No.: 530,667

[22] Filed: May 29, 1990

[51] Int. Cl.[5] ..... H01J 49/26

[52] U.S. Cl. ..... 250/282; 250/287

[58] Field of Search ..... 250/282, 287, 281

[56] References Cited

U.S. PATENT DOCUMENTS

| | | | |
|---|---|---|---|
| 4,037,100 | 7/1977 | Purser | 250/282 |
| 4,472,631 | 9/1984 | Enke et al. | 250/281 |
| 4,818,862 | 4/1989 | Congemius | 250/287 |

OTHER PUBLICATIONS

Matsuda, H., "A New Mass Spectrograph for the Analysis of Dissociation Fragments," *International J. Mass Spectrometry and Ion Processes,* vol. 91 (1989), pp. 11–17.

Richter, Lee J., et al., "Position Sensitive Detector Performance and Relevance to Time-Resolved Electron Energy Loss Spectroscopy," Rev. Sci. Instrum. 57 (8), Aug. 1986.

Pesch, Reinhold et al., "A Versatile Array Detection System," 37th ASMS Conference on Mass Spectrometry and Allied Topics, May 21–26, Miami Beach, Florida.

Eland, J. H. D., "A New Two-Parameter Mass Spectrometry," *Acc. Chem. Res.,* vol. 22, No. 11, 1989, pp. 381–387.

Hagan, et al., D. A., "Charge-Separation of Triply Charged Ions" *Rapid Communications in Mass Spectrometry,* vol. 3, No. 6, 1989, pp. 186–189.

Smith et al., R. D., "New Developments in Biochemical Mass Spectrometry: Electrospray Ionization," *Analytical Chemistry,* vol. 62 (1990), pp. 882–889.

Louter, et al., G. J., "A Very Sensitive Electro-Optical Simultaneous Ion Detection System," *Internat. J. of Mass Spectrometry and Ion Processes,* vol. 50 (1983), pp. 245–257.

Ouwerkerk, et al., C. E. D., "Simultaneous Ion Detection in a Double Focusing Mass Spectrometer with Specially Shaped Magnetic Pole Faces," *Internat. J. of Mass Spectrometry and Ion Processes,* vol. 70 (1986), pp. 79–96.

*Primary Examiner*—Jack I. Berman

*Attorney, Agent, or Firm*—Marger, Johnson, McCollom & Stolowitz, Inc.

[57] ABSTRACT

Dissociations of multiple-charged ions are detected and analyzed by charge-separation tandem mass spectrometry. Analyte molecules are ionized to form multiple-charged parent ions. A particular charge parent ion state is selected in a first-stage mass spectrometer and its mass-to-charge ratio (M/Z) is detected to determine its mass and charge. The selected parent ions are then dissociated, each into a plurality of fragments including a set of daughter ions each having a mass of at least one molecular weight and a charge of at least one. Sets of daughter ions resulting from the dissociation of one parent ion (sibling ions) vary in number but typically include two to four ions, one or more multiply-charged. A second stage mass spectrometer detects mass-to-charge ratio (m/z) of the daughter ions and a temporal or temporo-spatial relationship among them. This relationship is used to correlate the daughter ions to determine which (m/z) ratios belong to a set of sibling ions. Values of mass and charge of each of the sibling ions are determined simultaneously from their respective (m/z) ratios such that the sibling ion charges are integers and sum to the parent ion charge.

43 Claims, 5 Drawing Sheets

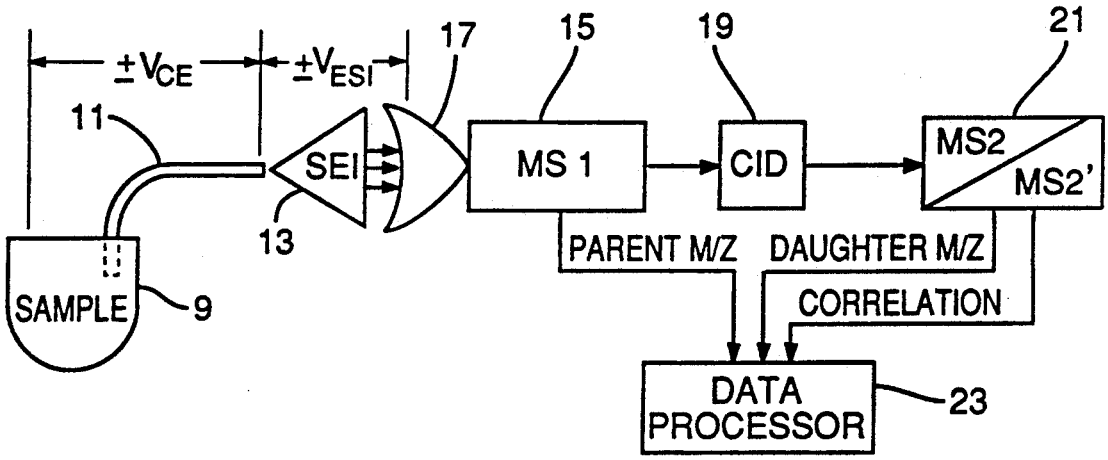
FIG. 2
FIG. 3(a)
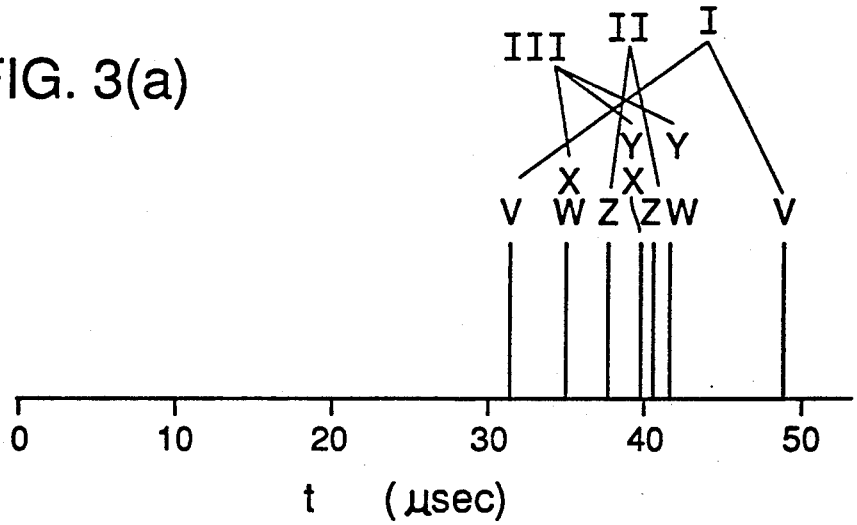
FIG. 3(b)
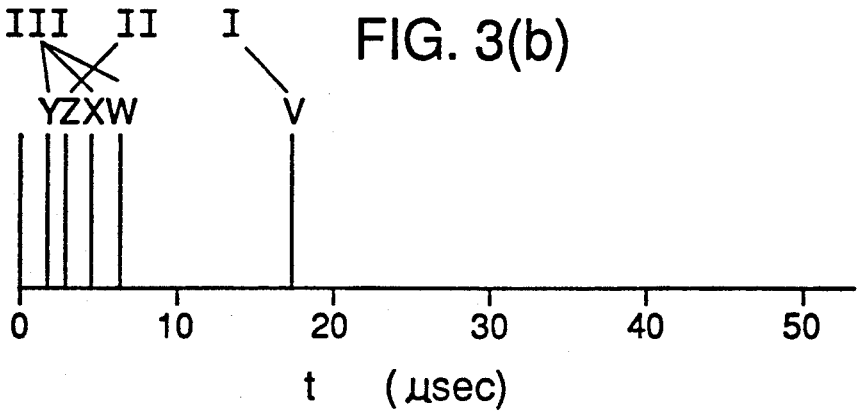

DETECTION METHOD FOR DISSOCIATION OF MULTIPLE-CHARGED IONS

BACKGROUND OF THE INVENTION

This invention was made with U.S. Government support under Contract No. DE-AC06-76RLO 1830 awarded by the U.S. Dept. of Energy to Battelle Memorial Institute. The U.S. Government has certain rights in the invention.

This invention relates to mass spectrometry and more particularly to a method for detection and analysis of multiple-charged ions and dissociated fragments thereof.

The analytical ability of mass spectrometry for large molecules has been greatly extended by techniques such as electrospray ionization which can produce intact molecular ions of high charge states (see R. D. Smith et al. "New Developments in Biochemical Mass Spectrometry: Electrospray Ionization" *Analytical Chemistry,* Vol. 62 (1990), pp. 882–889). In a normal ESI mass spectrum of a large molecule a distribution of charge states are formed. Since only m/z is measured, the molecular weight is calculated using the multiple m/z measurements which are known to differ by a charge of 1 due to the quantum nature of electronic charge. The calculation is straightforward since there are only two unknowns (m and z) and an abundance of m/z measurements.

In tandem mass spectrometry, however, the dissociation of only a specific charge state of the molecular ion is examined. Thus, while m and z of the "parent" ion are known (from the initial "conventional" ESI-mass spectrum), interpretation of the "daughter" ions formed from dissociation of a single parent charge state generally do not provide any such features. Thus, interpretation of daughter ion spectra in tandem MS/MS studies is problematic.

Two major problems remain to be solved to effectively exploit these techniques in important chemical and biological applications.

Improvements are needed in sensitivity so that femtomole ($10^{-15}$ mole) and, ideally, attomole ($10^{-18}$ mole) quantities of a molecular species can be analyzed by the methods of tandem mass spectrometry. In tandem mass spectrometry, intact molecular ions selected from a primary mass spectrum are caused to dissociate, due to either collisional or photo-induced activation, to yield structurally-informative fragment, or daughter, ions, which are analyzed in a second analyzer. Developments in simultaneous ion detection, using an array detector, have improved detection sensitivity over scanning mode detection (see G. J. Louter et al., "A Very Sensitive Electro-Optical Simultaneous Ion Detection System" *Internat. J. of Mass Spectrometry and Ion Processes,* Vol. 50 (1983), pp. 245–257 and C. E. D. Ouwerkerk et al. "Simultaneous Ion Detection in a Double Focusing Mass Spectrometer with Specially Shaped Magnetic Pole Faces" *Internat. J. of Mass Spectrometry and Ion Processes,* Vol. 70 (1986) pp. 79–96). Nonetheless, studies with singly charged ions, which until very recently were the only case being studied, are limited to maximum molecular weights of about 3000.

An improved method is needed for accurate assignment of charge and mass assignment to the daughters produced by the dissociation of multiple-charged parent ions. Mass spectrometers separate according to mass-to-charge ratios (m/z), not mass. For single-charged ions, interpretation is trivial. Recent development of an analytic technique called charge-separation mass spectrometry has extended the interpretation to the dissociation of double-charged ions (see J. H. D. Eland, "A New Two-Parameter Mass Spectrometry" *Acc. Chem. Res.,* Vol 22, No. 11, 1989, pp. 381–387) and of triply-charged ions (see D. A. Hagan and J. H. D. Eland, "Charge Separation of Triply Charged Ions" Rapid *Communications in Mass Spectrometry,* Vol. 3, No. 6, 1989, pp. 186–189). This technique employs single-stage time-of-flight mass spectrometry to obtain two-dimensional multi-ion coincidence spectra. So far, however, this technique is limited in application to dissociations inherent in the ionization process. The reported studies have been limited to simple molecular ion ($CS_2$ and $C_6D_6$) which present no ambiguities in assigning charge states to fragment ions. Double, triple and occasional quadruple-charged parent ions of relatively small molecules principally dissociate into neutral, single and double-charged fragment ions via a limited number of fragmentation pathways. These present little or no ambiguity in charge assignment. Stable or metastable triple-charge ions observed are a very small proportion of triply charged ions originally formed and are essentially ignored.

For dissociation of large, multiple-charged parent ions, there are virtually innumerable potential fragmentation pathways. Such dissociations yield more highly-charged daughter ion products, the charges of which are unknown, and many possible mass-to-charge ratios. The combinations of all these possibilities lead to severe ambiguities in charge and mass assignment. This situation has prevented application of prior art techniques to most analytical problems of real interest.

Accordingly, a need remains for an effective way to analyze complex molecules and ions.

SUMMARY OF THE INVENTION

A general object of the invention is to develop new methods and instrumentation for greatly enhanced mass spectrometric characterization of large biopolymers.

Another object is to improve analysis of a plurality of multiply-charged fragments of a multiply-charged parent ion.

A further object is to remove ambiguity in the analysis of up to four multiply-charged fragments of a large, multiply-charged parent ion.

A particular object is to extend the molecular weight range and provide analysis of biopolymers, such as enhanced sensitivity, compared to existing methods, for peptide and protein sequence determination.

An additional object is to develop an analytic approach of broad applicability based upon instrumentation having only a fraction of the cost of the large four sector tandem double focusing mass spectrometers which represent the current state-of-the-art.

Yet another object is to improve sensitivity of the analytic system over existing tandem mass spectrometry systems such as those which use four sector or triple quadropole mass spectrometers, and provide product ion correlation information not available on current instrumentation.

The invention is a new method and apparatus for the extension of direct mass spectrometric sequencing to large molecules, such as oligopeptides and proteins. This new approach holds the promise of providing a dramatic extension of the molecular weight range and sensitivity of current mass spectrometric methods based upon the large tandem double focusing instruments.

One aspect of the invention is a method for determining the collision induced dissociation (CID) products arising from individual (i.e., single ion) dissociation processes. In this approach, parent ions are first produced by ionization of large molecules, such as oligopeptides. The resultant parent ions are multiply charged (e.g., multiply protonated) stable molecular ions. A specific molecular ion charge state is then selected by a first stage mass filter. The mass-to-charge ratio of the selected ion is either predetermined or is determined by mass spectrometry in the first stage. Ions of the selected charge state are then collisionally dissociated. The products of the CID process, or daughter ions, are then analyzed using a second stage mass spectrometer which enables the daughter ions to be correlated to the dissociation process which produced them, and to produce mass-to-charge ratios for the daughter ions. This information is then analyzed to assign charge and mass to each of the daughter ions.

Electrospray ionization (ESI) and capillary electrophoresis (CE) methods can be used to extend direct sequence analysis capabilities to higher molecular weights (>20 kDa). ESI can be used to produce multiply protonated molecular ions of large oligopeptides. ESI produces a distinctive distribution of charge states of the parent ions, which can be analyzed to determine parent-ion charge and mass.

Daughter ions can be correlated in either of two ways to determine a sibling relationship among them (i.e., that they are products of a single dissociation event or identical fragmentation path). One way is by autocorrelation of the temporal relationship of daughter ions. The other is by direct correlation of temporal and spacial relationship of daughter ions to a single dissociation event.

Correlation data enables reliable assignment of charge and mass to several multiply-charged daughter ions. In an MS/MS spectrum for a singly charged ion a large number of peaks may be obtained, but there is generally only one charged daughter ion rising from dissociation of each singly charged "parent" ion. Interpretation of such spectra is straightforward since the mass of the daughter ion is known.

For multiply charged ions, however, such as formed by electrospray ionization and in particular, the larger (and highly charged ions) of great interest to mass spectrometry (e.g., proteins), there are very often (i.e., usually) two or even three charged products of each dissociation, each of which can carry more than one charge. In this situation, several general cases can be considered, which together account for the vast majority of dissociation processes for multiply charged ions. Consider a molecule of molecular weight M having Z charges. The most likely dissociation processes include:

$$M^{Z} \rightarrow M_a^{Z+} + M_b \quad (1)$$

$$\rightarrow M_a^{(Z-y)+} + Mb^{y+} \quad (2)$$

$$\rightarrow M_a^{a+} + M_b^{b+} + M_c^{c+} \quad (3)$$

(where $a+b+c=Z$)

In each reaction, we refer to the general case where $M_b$ or $M_c$ can have a mass of zero (which thus corresponds simply to a loss of charge(s)), or zero charge, where $c=0$ (which thus corresponds to the loss of neutral (uncharged) species).

Reactions (1) and (2) are trivial to solve if one knows that specific daughter ions in the mass spectrum arise from a particular parent ion. For example, if both charged products of Reaction 2 are known to arise from the parent ion (are sibling ions), there are four unknown values (the mass and charge of each daughter) and four known values (M, Z and the two m/z measurements). Thus, in this case, the two daughter products must include the sum of the mass (M) and charge (Z) of the parent ion (in mass spectrometry nomenclature these are called complementary ions).

It is important to note that even this determination cannot be made with much confidence for conventional spectra using current methods since there is no way to determine if two ions are actually complementary (arising from the same parent), or in fact arise from different processes. This is particularly true for large molecules with numerous charges where many thousands of different dissociation processes conforming to the general cases of Reactions (1)-(3) may contribute.

Importantly, the "single parent ion" time-resolved detection of daughter ions allows a nearly general solution to Reaction (3). This may initially seem surprising since, if three charged products are formed, there are six unknowns (m and z of each daughter) but only five knowns (M, Z, and the three m/z measurements). However, when one considers that electronic charge is limited to only integral values there is, in the vast majority of cases, only one realistic solution. Thus, the problem of charge state determination is effectively solved.

Moreover, the solution can be extended to the case of four daughter ions by making double guesses of two of the charge states. Most dissociation experiments can be readily controlled to produce two or three daughter ions, or less frequently, four ions.

An advantage of this approach is that, in conjunction with conventional mass spectrometric methods, the charge states of CID products are uniquely determined in nearly all instances. This approach circumvents existing limitations for CID of multiply charged ions. It provides the basis for study of much larger molecules with enhanced sensitivity since low probability CID processes can be correlated and detected. A further benefit of these detection methods is a large increase in sensitivity due to the great enhancement in signal/noise resulting from time-correlated detection. Since one analyzes spectra of correlated events overlapping, very low level (conventionally "lost in the noise") processes should be readily detected. The gain in effective sensitivity could amount to many orders of magnitude. Another benefit of this approach is that ions formed in relatively low charge states (at high m/z) can also be studied, likely allowing application to compounds where multiple charging is less extensive (i.e., glycoproteins). The new methods can also be applied to the direct peptide sequencing of tryptic digests and small proteins.

A second aspect of the invention is directed to novel apparatus for carrying out analyses in accordance with the foregoing method. Two broad classes of detection apparatus and methods are feasible based upon "full spectrum" array detection and time-of-flight (TOF) detection techniques. The first, array detection, utilizes spatial separation by m/z, while the second, TOF detection, is based upon temporal separation by m/z.

In the TOF approach, an ion dissociates to give products at a time which need not be precisely known. After products form, they are accelerated in an electric field for TOF measurement and arrive at the detector at time intervals separated according to their m/z values. Preferably, autocorrelation is used over a finite time interval to statistically determine sibling relationships among detected daughter ions. Alternatively, a low rate of parent ion input to the dissociation region can be used, by briefly (e.g. 20 ns.) gating the parent ion input, and analyze the detector output for each input cycle to assign sibling relationships based on data received during an appropriate time interval (e.g. 100 microsec.) for each input cycle. Since the gating interval is short enough that it will pass, on average, less than one parent ion, any detected daughter ions very probably are products of a single dissociation event.

The TOF apparatus preferably includes a new instrument, a tandem Wein-dual time of flight (Wein-TOF) mass spectrometer. A specific molecular ion charge state is selected by the first stage Wein mass filter and collisionally dissociated, preferably by colliding the selected ions in a collision gas cell, or alternatively by electron or photon bombardment or by surface collision. The products of the CID process are analyzed preferably using a novel dual reflectron TOF mass spectrometer which uniquely allows utilization of all the ions from the continuous ESI source. Alternative analytic apparatus include any mass spectrometer or combination of mass spectrometers that will provide, besides mass-to-charge ratios, an autocorrelation of product ion arrival time.

In a "full spectrum" array detection method, an array detector must be designed to allow time resolved detection of ions in a broad m/z range (e.g., m/z 50–3000). In this approach individual daughter ions can be detected with very high efficiency due to the short (−5 nanosecond) pulses from a microchannel array device and suitable detection method. The arrival of ions from a single dissociation event will be precisely correlated in position as well as time—i.e., there is generally little ambiguity in determining a sibling relationship among detected daughter ions.

The foregoing and other objects, features and advantages of the invention will become more readily apparent from the following detailed description of a preferred embodiment which proceeds with reference to the drawings.

BRIEF DESCRIPTION OF THE DRAWINGS

FIG. 2 is a block diagram of an analytic system used in the present invention.

FIGS. 3A and 3B are hypothetical mass spectra illustrating the analysis of the present invention.

DETAILED DESCRIPTION

General Procedure

Figure 1:
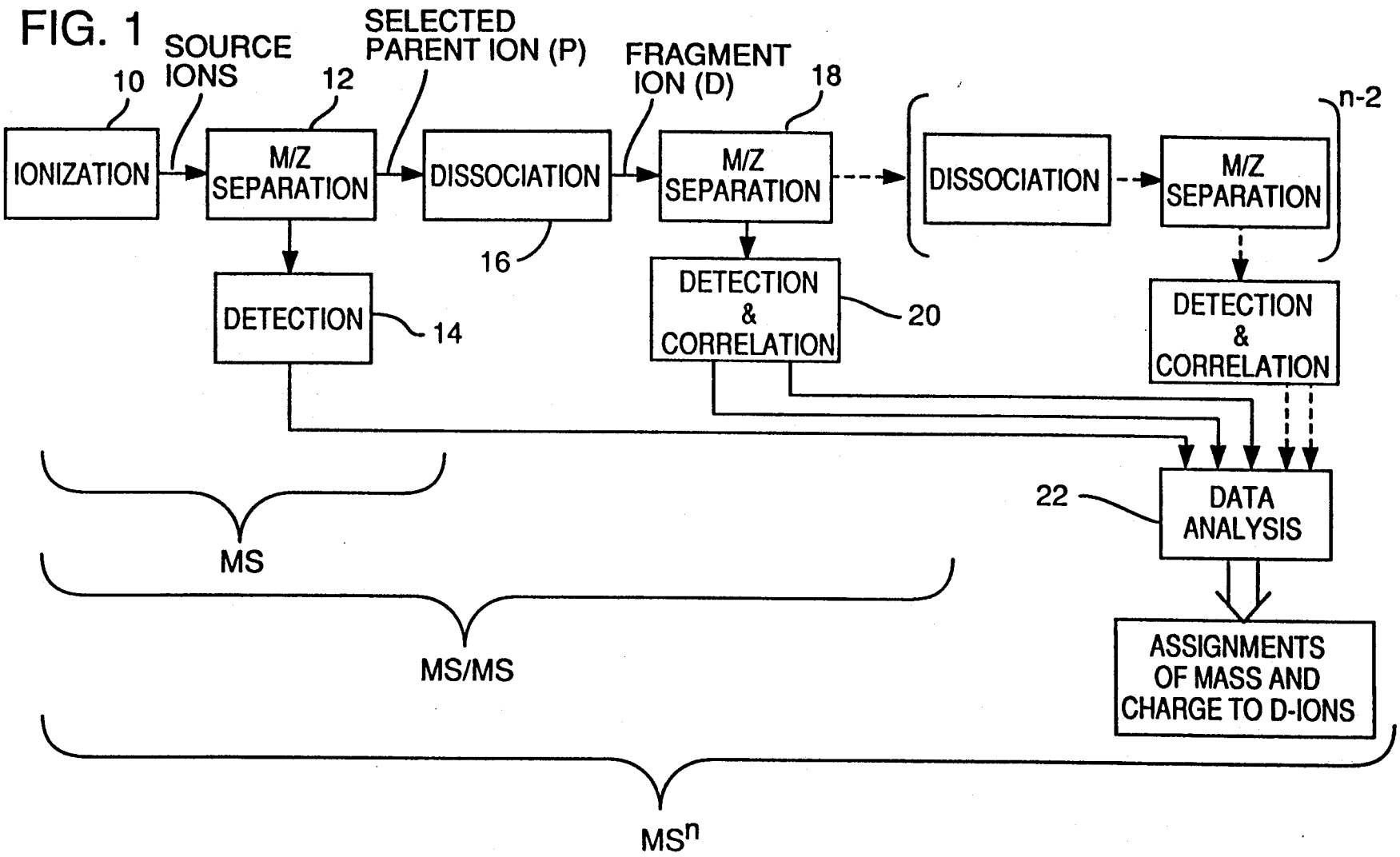
FIG. 1 is a process flow diagram of a tandem mass spectrometric analysis of parent and dissociated daughter ions as used in the present invention.

FIG. 1 illustrates in general form the inventive approach to the analysis of collision induced dissociation (CID) processes of multiply charged molecular ions. FIG. 2 shows a generalized example of apparatus for carrying out this process. These Figures can be discussed together.

The first step 10 in the basic process of FIG. 1 is to ionize analyte source molecules to produce source or parent ions. Preselection of the analyte parent molecules can be accomplished by various techniques, preferably by capillary electrophoresis or capillary isotachophoresis but suitably also by other techniques such as liquid chromatography. This is shown in FIG. 2, in which the analyte sample 9 is input via a capillary 11 to an ESI interface 13.

Electrospray ionization (ESI) is the preferred ionization technique for use in ionization step 10, although other techniques could be used. ESI has been shown to be broadly applicable to peptides and proteins, and to be highly sensitive, allowing femtomole size samples to be addressed. The ESI method generally produces multiply protonated molecular ions [i.e., $(M+nH)^{n+}$] peptides and proteins, with mass-to-charge ratios (m/z) ranging from ~m/z 600 to at least m/z 2000 based upon experience with quadrupole instruments.

The next step in the basic process is a separation step 12, by which a parent ion is selected according to its charge state. If mass and charge of the parent ion are not already known, a detection step 14 is performed to determine the mass and charge (m/z) of the parent ion(s). These steps preferably combined, as shown in FIG. 2, in a first stage of mass spectroscope 15 (MS1) having a differential pumping and preheating input system 17.

The selected parent ions are next collisionally dissociated in dissociation step 16 (FIG. 1). This step is preferably performed by colliding the selected ions in a collision gas cell 19 (CID), as shown in FIG. 2, or alternatively by electron or photon bombardment or by surface collision. CID of multiply charged ions produced by ESI is highly efficient due to the capability for their "pre-heating" in the input 17 from the ESI source. This step produces a number of fragments, including daughter ions having a wide range of mass and charge states, depending on the characteristics of the parent ion, its charge state and the energy of dissociation.

The next step is to separate and detect the mass spectrum (m/z) of the daughter ions, as indicated by steps 18, 20. This is step is performed using a second stage mass spectroscope 21 (MS2/MS2'), as shown in FIG. 2. This information is used in subsequent data analysis step 22 (FIG. 1) performed preferably by a suitable computer 23 (FIG. 2).

If conventional analytic techniques are used, however, interpretation of the CID spectra for large molecules having an unknown sequence from molecular ions with higher charge states (z·3) is largely prohibited since the charge state of the various CID products is unknown. Conventional mass spectrometric analytic methods are incapable of directly obtaining this charge state information. Given the concurrent sensitivity demands of most practical applications there has, until this time, been no truly satisfactory solution to this problem.

Our solution for "charge state determination problem" involves, in effect, the analysis of the dissociation products of individual multiply protonated molecular species. A general feature of these CID processes for multiply charged ions is the formation of two or more charged daughter ions. Our approach is to utilize the known mass and charge state of the (mass selected)

parent ion and the daughter ion mass-to-charge ratios, together with the quantum nature of electronic charge, to determine daughter ion charge states. This approach requires that the products of individual CID events be determined based upon information about the correlation of the detected ions, which is also indicated in step 20 of FIG. 1. This information is then used in subsequent data analysis steps 22 to aid in resolving charge and mass ambiguities.

Correlation information can obtained from the second stage mass spectrometer in essentially two ways.

One way is statistical, based on detection of daughter ions produced by dissociating a number of parent ions over some extended time interval. It employs two parallel time-of-flight (TOF) detection stages. The first stage uses a pulsed input of parent ions and produces a cross correlation of the time-off-light detector output and the gate function. This is, in fact, a conventional TOF mass spectrum, as shown in FIG. 3A, and will be referred as such. The second parallel TOF stage uses an essentially continuous input of parent ions. The raw data output of semirandom pulses from the second TOF detector is processed through an autocorrelation function to produce an autocorrelation TOF mass spectrum, as shown in FIG. 3B.

The spectra of FIGS. 3A and 3B are used together to determine the sibling relationships of daughter ions in the conventional TOF mass spectrum. Although preferably implemented on a cocomputer, using more complex statisitical algorithms, conceptually, determination of sibling ions can be done by overlaying FIG. 3B over FIG. 3A, initially aligning the origin of FIG. 3B with the left most pulse in FIG. 3A and identifying any other pulses that align in the two spectra. In this example, the first and last pulses match and are labeled "V". The autocorrelation spectrum is then shifted rightward until its origin aligns with the next pulse and, again, any other matches are identified. This time we find two matches. The peak underlying the origin is labeled with both "W" and "X" to indicate two matches, and the matching peaks to the right are labeled separately "X" and "W". This procedure continues until there are no more peaks left in the conventional spectrum to be matched. The singly-labeled peaks arise from a sibling ion pair, that is, a parent ion that disocciated into two ions. These pairs are identified by Roman numerals I and II. The doubly labeled peaks with interlocking labels arise from a sibling ion triplet, that is, three daughter ions from a single parent, and are labeled with Roman numeral III. This hypothetical example is explained more fully below.

Figure 4:
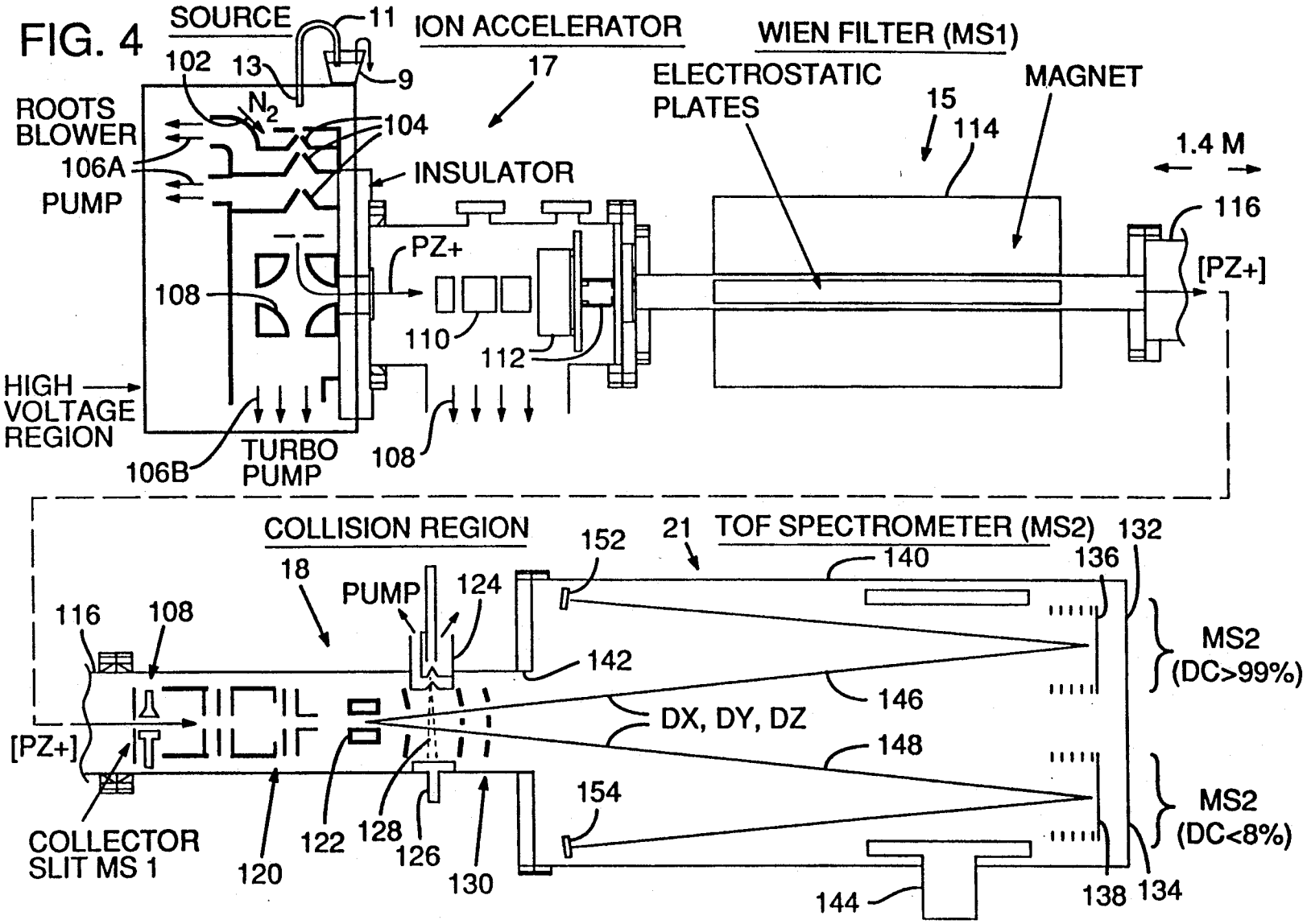
FIG. 4 is a schematic diagram of a preferred embodiment of tandem mass spectrometer apparatus used to implement the system of FIG. 2.

This approach is based upon use of a new tandem Wein-dual time of flight (Wein-TOF) tandem mass spectrometer, shown in FIG. 4. In the first stage Wein mass spectrometer, parent ions having a specific charge state are selected and decelerated into a collision cell where they undergo dissociation (i.e., CID). The second stage involves dual reflectron TOF analysis of a reaccelerated ion packet from the first stage Wein mass filter, which operates as discussed above.

Once the sibling ion relationships have been identified, this information can be used in the data analysis step 22, together with the fact that, in dissociation of a single ion, mass and a charge of the parent are conserved in the resulting fragments. From this information, using the mass-to-charge ratios of the parent and daughter ions, and the quantum nature of charge, the charge states of the fragments can be determined reliably for up to three multiply charged daughter ions and often for up to four multiply charged daughter ions.

In effect, the correlation analysis provides an additional dimension of information over conventional mass spectrometry. It is necessary for the data analysis step 22. An additional attribute of this method is that low probability CID events can be readily discerned, providing enhanced sensitivity for processes that might otherwise be obscured by conventional methods. Finally, both the Wein and TOF methods have essentially unlimited m/z ranges, allowing study of large ions (from glycoproteins for example) which may be formed in relatively low charge states.

As described further below, relatively simple algorithms can be used for this purpose. This combination of techniques provides unique charge state information. The method can readily be extended to much larger molecular weights, for example by adding n-2 dissociation and detection/correlation stages, as indicated by steps 24, 26, 28. This method also provides greater sensitivity than present alternative mass spectrometric methods.

The other way to determine correlation of sibling ions is deterministic, based on dissociation of a single parent ion. It preferably utilizes an array detector which can provide both time and positional information. The daughter ions produced by dissociation of a single parent ion can be linked as sibling ions by directly correlating the position and time relationships of arrival of ions at the array detector. This way is further described with reference to FIGS. 5 and 6 below.

The Correlated-Product Approach to Charge State Determination

A collision induced dissociation (CID) mass spectrum represents a composite of signals resulting from the summation of different dissociation processes for parent molecular ions occurring with different frequencies. The basis of our approach is to determine sibling ions, i.e., the daughter ions arising from CID of single parent ions or a single fragmentation pathway. The data manipulation and analysis methods (autocorrelation and direct correllation), and the instrumentation used to accomplish these procedures, are discussed in the following two sections. This section describes the interpretation of the data which arises from this unique approach to mass spectrometry. We show how unambiguous charge-state determination is afforded for most CID processes, and how the present methods can effectively enhance sensitivity.

The number of different CID processes possible for a large polypeptide is very large. For example, if we consider a cytochrome-C molecular ion having 110 residues ($M_r \sim 13{,}000$ Da), and consider only the cleavage of single backbone bond (i.e., yielding the a, b, c, x, y, z mode daughter ions), then over 1300 potential daughter ions are possible. More complex dissociation processes can occur (particularly using higher collision energies), including side chain losses, sequential dissociation processes, and perhaps charge or proton transfer to the collision gas. Hence, the possible number of daughter ions may be substantially larger. Additional complications can arise due to the range of possible daughter ion charge states arising from dissociation of a multiply charged parent ions. This adds an element of ambiguity that generally precludes spectral interpretation (unless the peptide sequence is already largely established).

Analysis begins with ionization of a parent molecules to form stable or metastable ion of mass M and charge Z. Both M and Z are known from interpretation of the ESI mass spectrum (see R. D. Smith et al. Anal. Chem. 62 (1990) 882-899). A parent ion of a particular charge state is selected and dissociated into a set of sibling fragments. Of principal interest is the situation where molecular ion internal energy does not greatly exceed that required for dissociation on the mass spectrometric time scale, so that more extensive dissociation processes are avoided (this is generally not a problem). The most likely dissociation processes can be generalized by reactions Rx[1]-[7].

$$M^{Z+} \rightarrow m_a^{x+} + m_b \qquad \text{Rx[1]}$$

$$M^{Z+} \rightarrow m_a^{x+} + y+ \qquad \text{Rx[2]}$$

$$M^{Z+} \rightarrow m_a^{x+} + m_b^{y+} \qquad \text{Rx[3]}$$

$$M^{Z+} \rightarrow m_a^{x+} + m_b^{y+} + m_c \qquad \text{Rx[4]}$$

$$M^{Z+} \rightarrow m_a^{x+} + m_b^{y+} + z+ \qquad \text{Rx[5]}$$

$$M^{Z+} \rightarrow m_a^{x+} + m_b^{y+} + m_c^{z+} \qquad \text{Rx[6]}$$

$$M^{Z+} \rightarrow m_a^{x+} + m_b^{y+} + m_c^{z+} + m_d \qquad \text{Rx[7]}$$

where $m_a + m_b + m_c = M$ $x + y + z = Z$, and $y+$ and $z+$ designate (undetected) charge loss processes.

Each reaction may represent hundreds, or even thousands, of possible CID processes. It should also be noted that the neutral products ($m_b$, $m_c$ or $m_d$) may represent the sum of several smaller neutral species.

The vast majority of all CID processes of interest are expected to conform to these general reactions, unless excessive internal energy is deposited in the molecular ion (facilitating additional sequential dissociation steps). The conditions normally selected for CID in this invention are determined experimentally to limit most dissociations to those yielding only two or three charged products from among the large number of similarly feasible processes.

An important feature of most CID processes for each multiply charged parent ions is the formation of more than one daughter ion. With the possible exception of simple cleavage to form "complementary ions" by reaction Rx[3], the absence of charge state information prevents reliable assignment of peaks in the mass spectrum to specific CID processes. Even for large polypeptide of known sequence, the interpretation of CID spectra can still be difficult.

If daughter ions arising from individual CID events can be correlated (as discussed in the next section), then interpretation and unambiguous charge state assignment becomes feasible in most cases. This is possible for two reasons: the fact that total mass M and charge Z are known, and that electronic charge is restricted to integral values. (Although mass is restricted to nominally integer values, insufficient resolution is available, except by Fourier transform ion cyclotron resonance (FT-ICR), to exploit this for charge state assignment.)

Below, we briefly consider the general reactions Rx[1]-[7], grouped in terms of the number of detected (charged) CID products, and show the reasoning used for charge state determination. The reasoning used for this analysis is straight-forward, can be extended to more complex situations, and can be readily implemented as algorithms into automated interpretation methods.

a. Dissociations yielding one charged product

In this category we consider only CID products at m/z values that cannot also be attributed to any correlated events (i.e., ions that are also observed for Rx[3]-Rx[7]. This is necessary since imperfect detection efficiency will cause some portion of the charged products of Rx[3]-[7]not to be detected, and appear as uncorrelated events.

The remaining "real" single product ion events constitute the simplest type of CID processes encountered. These include the cases where the single charged product is accompanied by an uncharged neutral product (Rx[1]) or arises due to a change in charge state (Rx[2]). If the detected product corresponds precisely to that for gain or loss of one charge (Rx[2]), then a simple change of charge state (proton or charge transfer) should be considered the most likely reaction. If such products are particularly abundant, then loss or gain of several charges must also be considered. If a shift to lower m/z occurs, not corresponding to Rx[2], only Rx[1] is possible and assignment of $m_a$ is trivial (since $x=Z$).

Note that in specialized, and probably much less frequent cases, slightly more sophisticated interpretation methods will be useful. For example, if both Rx[1] and Rx[2] occur with high frequency, then their combination involving both charge exchange and neutral loss must necessarily to be considered. The possible importance of such a process will be clearly evident if both Rx[1] and Rx[2] are important. Again, very simple computer-based algorithms having this level of "artificial intelligence" can be implemented as necessary to provide automated assignment of such processes.

Thus, interpretation of single ion events is relatively straight-forward. However, we consider this class of CID processes to be both less abundant and less informative than those yielding two or three products charged as discussed below.

b. Dissociations yielding two charged products

Reaction Rx[3], which yields complementary ions, has a trivial solution if the detected ions are determined to be siblings. There are strictly four unknown parameters ($m_a$, $m_b$, x, and y) and four known parameters [(M and Z from the parent ion, ($m_a$/x) and ($m_b$/y) from the detected sibling ions]. Thus, charge states for the two products are easily and unambiguously calculated.

Rx[4] and Rx[5] represent cases where two charged products are detected, but a neutral product loss or charge exchange process also occurs. These two processes are actually subsets of the broader class denoted by Rx[6], where one product has either a charge of zero or a mass of zero. Strictly speaking, there is no solution yielding charge state in such cases since there are 5 unknown parameters but still only four known parameters. When one considers the quantum nature of electronic charge, however, a reasonable solution for moderately sized molecules ($Z>30$ or $M_r$ s(>,~) 30 kDa, depending upon resolution) is nearly always obtained. Restriction of charge states to integral values, where the sum for both charged products must equal Z, almost always results in an easily identified solution for product charge states.

For example, consider a parent ion of MW=20,000 with Z=20 (for a parent ion thus having m/z 1000)

undergoing a dissociation process described by Rx[4]. If two daughter ions of m/z 600 and 1059 are observed, the possible neutral products are described by the series 200, 654, 1118, 1572, . . . etc. We generally consider the loss of large uncharged fragments much less likely than small neutral products, and the 200 loss would be judged more likely. Any knowledge of molecular structure or consideration of likely neutral fragments, such as from the most likely modes of polypeptide dissociation, would greatly aid and simplify further such interpretation and could be used in an expert system to refine or revise such a tentative assignments. Assuming the likely case, in which $m_c=200$ is reasonable, the CID event must have yielded two charged products of 18,000 dalton with 17 charges, and 1,800 dalton with 3 charges.

The general approach for Rx[5] is even simpler and would likely constitute the first evaluation step for automated analysis/interpretation for the case of two correlated products which are not due to complementary ions (Rx[4]). The restriction to integral charge values restricts x and y in Rx[5] to a limited set of values. Thus, this case is actually only a minor variation on the trivial case described by Rx[3], since it simply involves changing z slightly (by integer steps) to evaluate possible solutions. Thus, we see that, for the case of two charged products, unambiguous charge state information is generally obtained. Any uncertainties, such as those arising due to the possibility of large neutral products in Rx[4], should be addressable by consideration of reasonable neutral losses for the compound class of interest (i.e., polypeptides).

c. Dissociations yielding three charged products

The formation of three charged products again presents a case where there is strictly no useful solution (i.e., five known parameters, six unknowns). The restriction of charge state to integer values, however, almost always provides an easily obtained solution. Since the total mass and charge for all products is known in the case of Rx[6], the approach is relatively simple.

For example, a simple evaluation algorithm would be select the lowest m/z ion (which our experience has shown to generally be an ion of low charge state) and to assign it a charge of between 0 and Z. The remaining charge and mass must then be distributed between the other two products, which can now be treated as for the trivial case of Rx[3]. If integer values of charge result from this calculation for all three products (within reasonable limits), one can safely assume that the correct solution has been found.

The limitations of these methods are defined by the uncertainty in calculated Z values, which are related to charge state, resolution and m/z assignment accuracy However, a resolution of 1000 generally will afford useful measurements to at least Z=30, or M=30,000.

For the case of Rx[7], the most complicated case we consider to be very likely, three charged products and one (or more) neutral product are formed. The approach here is similar to that already discussed for the cases of Rx[4] and Rx[5]. As for Rx[4], acceptable integer charge states will exist for solutions having a series of possible neutral product losses (differing by a constant value). The approach, as in the case of Rx[4], involves making the assumption that smaller neutral losses are the most likely. Selection of the likely neutral loss would also utilize any prior knowledge of the chemical species, and other neutral losses identified for Rx[1] and Rx[4].

While more complex CID processes than Rx[7] may certainly occur, the cases described above will represent the vast majority of cases. It is important to remember that the extent of dissociation, and (less directly) the number of CID products, is a function of the internal excitation of the parent ion. This is a primary experimental variable in CID studies through the variation of either collision energy or collision gas density.

Thus, the data acquisition and analysis and the instrumentation described in the next two sections make it is possible to obtain experimental data whereby algorithms based upon the methods outlined above, or some variation on these approaches, allows interpretation of most of the CID spectra to yield daughter ion charge state. This information can then be used for interpretation of the primary structure of biopolymers.

Data Acquisition and Analysis

Our approach to mass spectrometry is unconventional and requires essentially new methods of data acquisition and handling. An important point to recognize, however, is that the data acquisition hardware is based upon available "off the shelf" electronic components. The unusual aspects of our approach arise from the correlated-product information we desire. This information is obtained from the combination of data handling methods conducted in software (e.g., primarily the correlation analysis), and the methods used for obtaining charge state information based upon the concepts and algorithms qualitatively outlined in the next section. The analysis of product-correlated mass spectra can be improved by implementation of computer based methods for such data analysis, particularly to simplify and speed the goal of obtaining biopolymer structural information (i.e., the sequence).

Our methods have their origin in the well-established principles for the analysis of correlated events. Correlation can take a number of forms. We use both autocorrelation, described next, and direct correlation, described below.

The autocorrelation function defined by the expression $$g(pi) = \text{Integral of } f(t-tau)\, f(t)\, dt)$$

has the property of revealing all the time correlations in the signal defined by the real-valued function f(t). For our purposes, signals composed of pulses are the most interesting because they are of the type produced by the detector for the arrival of individual ions in time of flight (TOF) mass spectrometry.

Consider a signal composed of two pulses; the first occurring at time $t_1$ and the second at time $t_2$ The autocorrelation function of this signal also contains two pulses. One occurs at t=0 and contains no useful information. The second occurs at $t=t_2-t_1$ and reveals the time difference between the two pulses in the original signal. This illustrates two important properties of the autocorrelation function:

1) It contains all the information about correlations between the features in f(t) (e.g., tau);

and 2) It removes all information about the time origin of the events recorded in f(t), (e.g., $t_1$).

A triplet of correlated pulses produces a slightly different signature. In addition to the pulse at t=0, the autocorrelation function produces pulses at $t=t_2-t_1$, $t=t_3-t_1$ and $t=t_3-t_2$. In other words, the autocorrelation function records all three of the time differences that define f(t) and removes the information on the time origin of the pulse triplet.

The autocorrelation function has the property that, in the limit of long acquisition time, uncorrelated features do not contribute to the autocorrelation function. Therefore, the autocorrelation function reveals the correlations inherent in a signal, even in the presence of a considerable background of uncorrelated signals. This has two consequences. One is that a signal composed of a fixed pattern of pulses repeated at random times produces an autocorrelation function similar to that of a single repetition of the pattern.

A second consequence is that, if there are several distinct patterns repeated at random in the signal, the autocorrelation function is similar to the sum of the auto correlation functions of each pattern taken separately. In other words, there is no "cross-talk" between the patterns. (It should be noted that this applies to the long acquisition time limit. For finite acquisition times, some cross-talk exists in the form of random noise in the autocorrelation function. The signal-to-noise ratio improves as the square root of the acquisition time.)

These properties of the autocorrelation function make it potentially very useful for the study of collision induced dissociation (CID) of multiply charged ions. A continuous beam of m/z-selected parent ions passing through a collision cell will undergo random collisions and dissociations. For different parent ions, these events are uncorrelated. Each dissociation event "chooses" one of many possible dissociation pathways. If the daughter ions are then accelerated and directed through a time of flight (TOF) stage, the daughter ions arising from a given dissociation event will arrive at the detector with a fixed time relationship between them. It is impossible to determine the flight times of the ions because, unlike a conventional time of flight spectrum, there is no way to generate a start pulse (i.e., the ions dissociate at indeterminate times). However, it is possible to know the flight time differences for daughter ions. The autocorrelation function reveals all the flight time differences for correlated daughter ions.

Each possible dissociation pathway leaves its pattern in the autocorrelation function. Since ion dissociations are random events, there is no cross-talk between the dissociation pathways, and the autocorrelation function is simply the sum of the auto correlation functions of each separate pathway (weighted by an appropriate probability factor.)

At this stage of the analysis, it might appear that the autocorrelation "spectrum" is of only limited use because it is a sum of separate correlation spectra. The natural groupings of daughter ions cannot be determined from the correlation spectrum alone. Much the same thing can be said of a conventional time of flight mass spectrum of daughter ions. The inherent correlations among daughter ions arising from the same parent (i.e. sibling ions) become lost as repetitive spectra are summed.

However, something almost magical happens when the information revealed by the autocorrelation spectrum is combined with the information from a conventional time of flight spectrum. In most cases, it allows one to reconstruct the lost information and allows one to identify sets of daughter ions as arising from the same dissociation pathway or event (i.e., sibling ions).

This is best explained by demonstrating with a hypothetical example. Suppose the parent ion is M=20,000 with Z=13. Assume there are three separate fragmentation pathways. Pathway 1 produces a pair of products with (m, z, t)=(12,000, 5, 48.990) and (8000, 8, 31.623) where t is the flight time in microseconds. Pathway 2 produces a pair of products with (m, z, t)=(10,000, 6, 40.825) and (10,000, 7, 37.796). Pathway 3 produces a triplet of daughter ions with (m, z, t)=(8,000, 5, 40.000), (7,000, 4, 41.833) and (5,000, 4, 35.355).

FIG. 3A shows the conventional time of flight spectrum (for just these pathways) and FIG. 3B shows the autocorrelation spectrum for this example. By matching peak positions in the autocorrelation spectrum with time differences in the conventional time of flight spectrum, we can make correlation assignments in the conventional mass spectrum and hence identify products arising from the same fragmentation pathway. For example, the peaks at t=31.623 and 48.990 in the conventional mass spectrum have a tau that matches a peak in the autocorrelation spectrum at t=17.367. Hence we label these two peaks with a common label (V), indicating a daughter ion pair likely arising from the same fragmentation pathway. (The capital letter labels indicate pair-wise correlations of probable sibling ions.)

An interesting case occurs in identification of a correlated triplet. A combination of interlocking pair assignments similar to the patterns of peaks labeled W, X and Z is a characteristic fingerprint of a daughter ion triplet. Thus, higher order correlations are identifiable. The Roman numerals (I, II, III) in the figure indicate the final grouping of the peaks into natural correlation groups. By analysis of the data in this fashion, one can assign the daughter ion correlations and then apply the algorithms outlined in the next section to determine z for each daughter ion.

The possibility exists that some false matches will be made, resulting in an occasional false assignment. These are relatively low probability situations. And the ability to rapidly and correctly identify most of the correlations more than makes up for such an occasional miss-assignment. Furthermore, a check on internal consistency can be made. When the algorithm for determining z is applied, a nonsensical value for z (i.e., a non-integer value) should allow one to reject most cases of misassignment in the correlation analysis.

One question that might arise is whether it is really necessary to do an autocorrelation on a raw data stream. Couldn't one simply acquire a conventional TOF spectrum, with enough signal averaging to obtain a good signal to noise ratio, and then autocorrelate the resulting TOF spectrum? If so, there could be a considerable savings in resources and effort. The answer is generally no; it will not restore correlation information that has been lost. More specifically, this procedure usually does not allow one to specify which peaks in the TOF spectrum are not correlated.

For example, in the hypothetical system discussed above (FIGS. 3A and 3B), such a procedure would produce an extra peak at tau=0.825, falsely suggesting that the daughter ions (10,00, 6, 40.825) and (8,000, 5, 40.000) are connected via a common fragmentation process. This is not an isolated problem. This procedure would produce an autocorrelation function with peaks at all possible time differences between the TOF peaks, not just those connected via common fragmentation pathways. Thus, this alternative procedure generates no new information.

The exception to this, which is within the scope of the present invention, is where only one ion is selected for each conventional TOF spectrum and each sampled TOF cycle is processed separately, with no signal averaging between TOF cycles. For this variation, correlation between daughter ions and a single parent ion is straightforward since the daughter ions presumably arise from a single dissociation event established by sampling of no more than one parent ion per TOF cycle. Therefore, autocorrelation is unnecessary in this alternative approach to the invention. Limitations upon detection efficiency combined with the short duty cycle, however, limit the potential of this approach. The array detector/direct correlation approach discussed below is preferred over sampled TOF correlation.

As indicated above, the electronic hardware required for the autocorrelation is readily available. The ideal implementation would be to use a full hardware correlator. However, the commercially available hardware correlators (e.g., from Malvern Instruments or Brookhaven Instruments) have neither the time resolution nor the number of channels required for this application. A combined hardware/software approach, however, although slower, is readily adapted to this application. The hardware required amounts to a computer 23 (FIG. 2) to do the processing, interfaced to a relatively simple circuit. The circuit has a free-running oscillator, a resettable counter clocked by the oscillator, a discriminator for converting detector pulses due to detection of daughter ions into standard logic pulses, a memory for storing clock readings corresponding to the timing of the logic pulses, and I/O circuitry for the computer to access the stored clock readings. Two of these units are used with the system of FIG. 4 to handle both the conventional TOF data stream (counter reset at start of each TOF cycle) and the autocorrelation data stream (counter preferably reset after storage of each reading) from the dual reflectron TOF analyzers.

Figure 5:
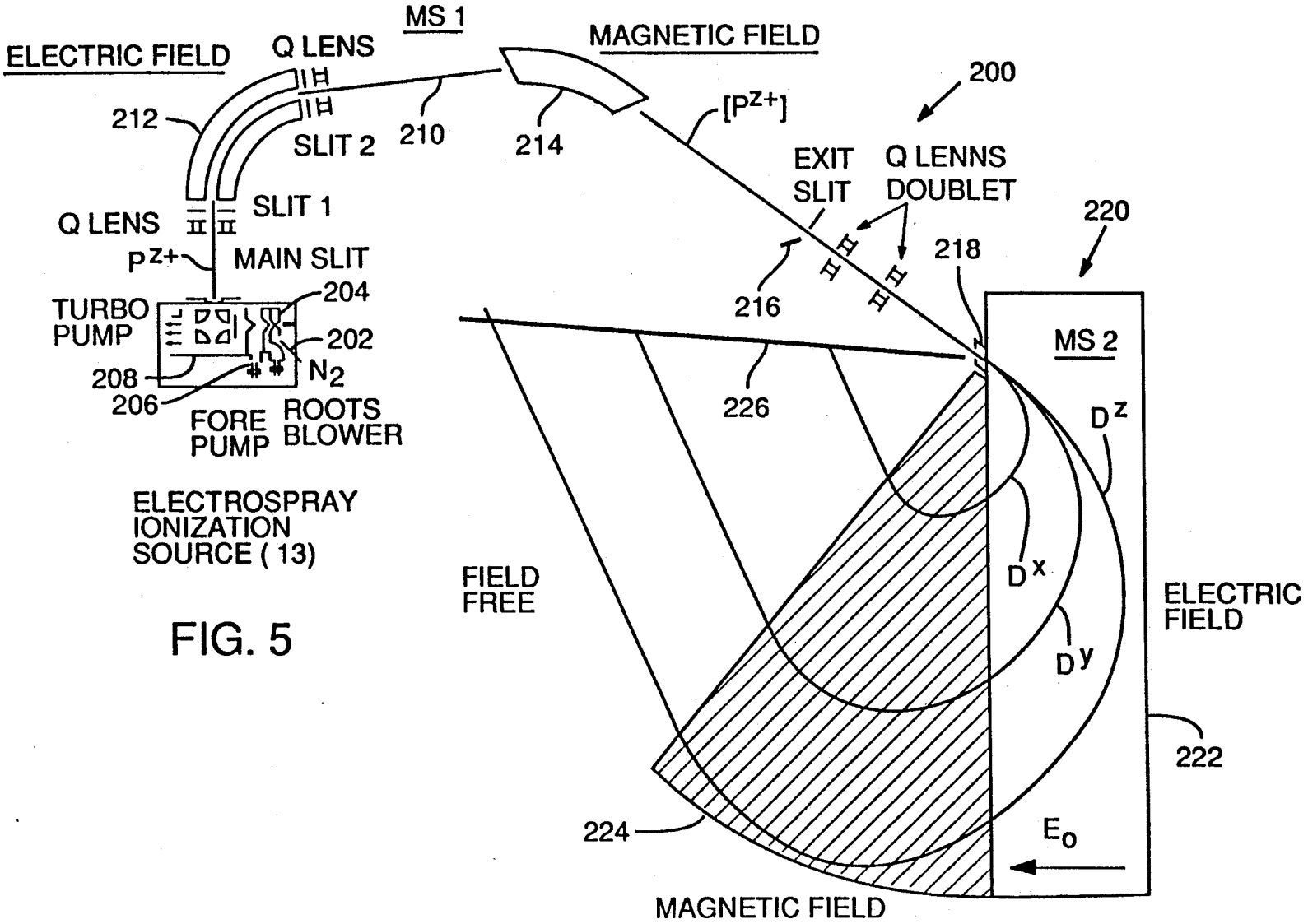
FIG. 5 is a schematic diagram of an alternate embodiment of tandem mass spectrometer that can be used in the present invention.
Figure 6:
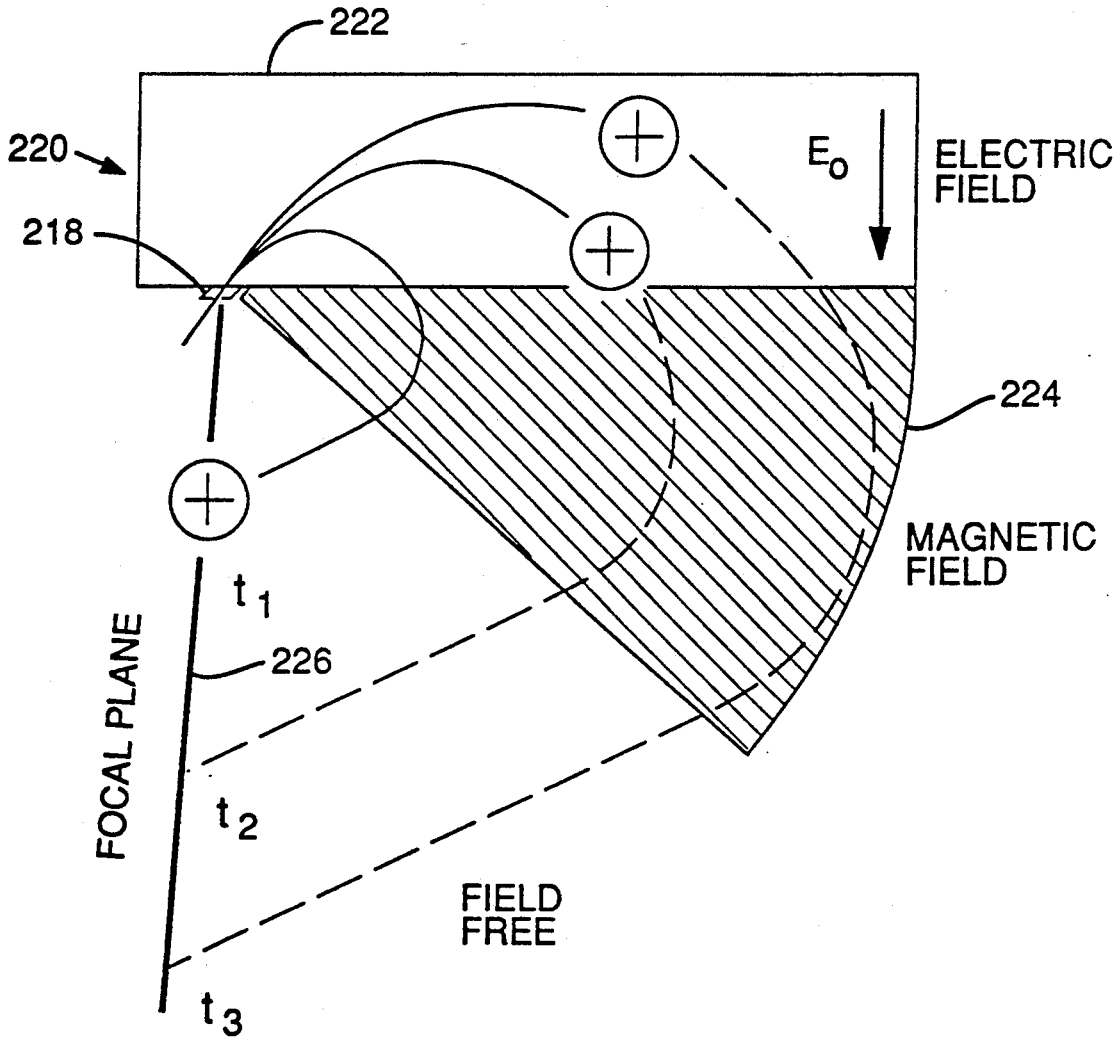
FIG. 6 is a diagram showing operation of the tandem mass spectrometer of FIG. 5.

Data acquisition and analysis for full spectrum array detector, as shown for example in FIGS. 5 and 6, is capable of supplying both time and position of ion detection in the second stage mass spectrometer (MS2). This mass spectrometer must be capable of dispersing ions in space in accordance with their m/z values. It also disperses the ions in time. This approach is closer to the sampled TOF technique than to the autocorrelation TOF technique, but has the advantage of a 100% duty cycle. Like sampled TOF, the fact that a number of detected daughter ions are siblings is established nonstatistically and virtually eliminates the possibility of incorrect sibling assignments.

It is unnecessary with an array-type detector to have a start pulse (as in sampled TOF) or both conventional and autocorrelation spectra (as in autocorrelation TOF) to determine sibling relationships. Instead, referring to FIG. 6, such relationship is determined by a combination of both position and time of detected ions. Both time and position are determined by the m/z dispersion characteristics of the particular form of mass spectrometer that is used. A first-detected ion has a flight time $t_1$ determined by the instrument design, which is known, and a second detected ion has a flight time $t_2$ which is similarly known.

An ion traverses a mass spectrometer in a time determined by the instrument design and the mass-to-charge ratio of the ion. Therefore, two ions arising from the same dissociation event have a flight time difference that is a known function f(m/z) of the two mass-to-charge ratios of the ions. The difference between these two instrument flight time times can be defined as Delta $t_{i12}$. That is, $$\text{Delta } t_{i12} = t_2 - t_1$$

where $t_2$ and $t_1$ are the instrument flight times.

Delta $t_{d12}$ can be defined as the measured time difference of detection of two ions, which may be but are not necessarily sibling ions. For two ions to be siblings, the detected time difference should equal the instrument flight time difference. That is, $$\text{Delta } t_{d12} = \text{Delta } t_{i12}$$

Thus, sibling ions are correlated by the relationship:

$$t_2 - t_1 = f(m2/z2) - f(m1/z1)$$

where f(m/z) is a predetermined function of the mass-to-charge ratios of two detected daughter ions and $t_2 - t_1 = \text{Delta } t_{d12}$, which is the detected time difference. Detected ions that meet this relationship are sibling ions. If detected ions do not meet this relationship, they are not siblings. This relationship can be extended to find additional sibling ions.

For example, in the type of mass spectrometer shown in FIGS. 5 and 6, both the position and time of detection are linear functions of m/z measured with reference to the dissociation origin. An ion of m1/z1 arrives at the detector at a time t1 (relative to the dissociation event at t=0) at a first unique linear position along the array. If a second ion is detected at a second position, it can only be a sibling ion if detected at a time which, for a linear system, can be shown to be:

$$t_2 = t_1 \times (m_2/z_2) \times (z_1/m_1),$$

where the detected Delta $t_{d12} = t_2 - t_1$ and the time $t_1$ is known from the instrument design because, for an ion to be detected at a certain position, the design requires the ion to have some known flight trajectory and flight time from the point of dissociation. Similarly, for a third ion $$t_3 = t_1 \times (m_3/z_3) \times (z_1/m_1).$$

It is unnecessary to supply a start pulse because the time difference between t1 and t2 is uniquely determined by the geometry of the mass spectrometer. Therefore, if pulses are detected at the first and second positions with a time difference not equal to that implied by the foregoing equation, it is known that they are not correlated and, hence, not sibling ions. This approach separates sets of sibling ions like autocorrelation but, because position data is also used, it does so without the statistical probability of accidental misassignment of sibling relationship. The only possibility of misassignment in an array detector arises if two parent ions dissociate simultaneously along different fragmentation pathways.

Using an array detector, it is not necessary to use a hardware or hardware/software autocorrelator. The physical structure of the preferred array detector is similar to that of C. E. D. Ouwerkerk et al. in using a microchannel plate and discrete anodes, but has more anodes (e.g., 4000 anodes) and is preferably finer (e.g., 100 micrometer). The major differences are full mass-range detection (over 90% vs. 6–40% in prior detectors) and time is directly detected with high resolution (on the order of 100 ns.) as well as detection of position. Also, time is used in a novel way: to correlate sibling ions. Time is detected using circuitry similar to that described above for the TOF autocorrelation system. Position is preferably detected using discrete anode readout of a microchannel plate array similar to those techniques described by Lee J. Richter and Wilson Ho in "Position Sensitive Detector Performance . . . " *Review of Scientific Instruments,* Vol. 57 (1986) pp. 1469–1482 for electron energy spectroscopy. The data provided to the computer 23 in this case is channel number, which indicates detection position m/z, and high resolution (order of magnitude of 100 ns.) timer readout data and separate readouts for each anode.

Instrumentation

There are many conceivable approaches to obtaining the desired product-correlated CID mass spectra. Two alternative approaches are described below. These alternatives were selected based upon the desire to: (a) enhance sensitivity compared to triple quadrupole methods, (b) provide the capability for an extended m/z range, (c) have a mode of operation compatible with the essentially continuous operation of an ESI source (to optimize sensitivity), and (d) minimize instrumentation cost and complexity.

The first embodiment is a dual tandem time-of-flight (TOF) mass spectrometry system 100 which is used with the autocorrelation technique discussed above. The second embodiment is a tandem array detection mass spectrometer 200 which provides direct correlation data. Both embodiments enable determination of sibling relationships among CID fragments for use in assigning charge and mass to the fragments by using the algoriths discussed above.

The instrumentation 100, 200 is the first use of coincidence methods for the analysis of CID processes. Probably the most similar experimental studies are those of Eland and coworkers who have examined the charge separation of small double and triply charged ions by electron impact. The experimental methods used by these workers share some similarities with those of the present invention. It is important to note important differences, however, including (a) the present extension to tandem mass spectrometry, (b) application of a novel self-correlation and direct correlation methods, and (c) the introduction of algorithms for charge state determination.

a. Tandem Wein-dual TOF Mass Spectrometer

The first embodiment is based upon the combination of a first stage Wein spectrometer with a dual reflectron time of flight (TOF) second stage. FIG. 4 gives a schematic illustration of the tandem Wein-dual TOF system 100.

The instrumentation 100 detailed in FIG. 4 corresponds to the general arrangement shown in FIG. 2. It includes a analyte sample source 9, capillary 11, and electrospray ionization (ESI) interface 13, and ion input system 17. The ion input system includes an $N_2$ preheating and desolvation gas input 102, a nozzle-skimmer arrangement 104, a differential vacuum pumping subsystem 106A, 106B and 106E, a quadrupole deflector 108. Examples of these elements are disclosed in U.S. Pat. No. 4,542,293 to Fenn et al. and U.S. Pat. No. 4,842,701 to Smith et al. Parent ions $P^{Z+}$ of several to many highly-charged states ($Z \geqq 4$ and typically $Z > 24$, e.g., 10 to 30) are produced at near atmospheric pressure, desolvated, and reduced to near-vacuum pressure conditions (e.g., $10^{-5}$ Torr).

A quadrupole deflection element 108 in the ESI interface prevents propagation of an intense neutral molecular beam of parent molecules through the instrument. An intense molecular beam can substantially degrade experimental performance (by causing CID or ion scattering in otherwise unexpected regions of the mass spectrometer), and can lead to difficulties in ion focusing. A collisional heating capability such as input 102 is used in the various differentially pumped regions; larger m/z ions require lower pressures for effective heating. The ion source and differential pumping regions are preferably isolated at high voltage, thus provided the capability of ion energies up to 30 keV for singly charged ions.

The parent ions are accelerated by deflector 108 through an Einsel lens 110 and deflection plates 112 into a first stage mass spectrometer 15 (MS1) in the form of a Wein filter 114. This device selects a particular charge state of the parent ions $[P^{Z+}]$ and passes the selected ions into a drift tube 116. The Wein mass spectrometer 114 provides extremely high transmission efficiency with an effectively unlimited m/z range, well matched to that of the second stage TOF. This combination allows the study of parent ions extending to at least m/z 50,000, which has not been feasible to date with ESI.

As noted above, we suspect important classes of biopolymers (e.g., glycoproteins) to have substantially lower charge states, and higher m/z, than the proteins successfully addressed to date by ESI. This instrument enables researchers to investigate the potential for CID of large m/z ions "pre-heated" in the interface. The Wein spectrometer also provides a velocity selected, spatially focused ion beam that is well-suited for subsequent CID and the second stage TOF analysis. A resolution in the range of 500 to 1500 (e.g., comparable to quadrupole instruments) is expected depending upon the selected slit width.

The drift tube couples the selected ions $[P^{Z+}]$ into a collision region. The collision region includes a detector 118, such as a particle multiplier to monitor the primary ion beam when selected using a set of beam deflection elements. This detector will allow scanning the Wein spectrometer for obtaining conventional parent ion mass spectra with high sensitivity over a mass range extending to at least m/z 50,000. This data is used to select parent ions by charge state and to determined parent ion mass M and charge Z. Once this data is obtained, the selected parent ions are passed through a decelleration lens 120 to a deflector 122, the purpose of which is explained below.

From the deflector, the selected parent ions pass through a collision gas cell 19, having a collision gas inlet structure 124 and a cryo pump 126 for passing a jet 128 of collision gas across the parent ion path. The collision region preferably utilizes a "floating" collision cell allowing collisions with energies (for singly charged ions) ranging from 50 eV to about 5000 eV. In general, the selected parent ions will be decelerated after the first stage m/z selection, dissociated by collisions with gas molecules in the gas jet, and then reaccelerated after CID. The collision cell provides a well collimated neutral gas jet for CID and has a large differential pumping capability based upon cryopumps.

Collisions with the curtain gas cause the parent ions to dissociate, each into a set of several (typically two to four) fragments, some or all of which are multiply-charged. The fragmentation pathway can vary from such parent ion, producing set of fragments of differing mass and charge. To indicate the general case, these fragments are designated generally as $D^x$, $D^y$ and $D^z$, where each daughter typically has a different mass $M^a$, $M^b$ and $M^c$, respectively. The superscripts x, y and z denote the charges on the daughter ions. The charges can vary from O to Z but must sum to Z so that at least one and typically more than one of the daughter ions are multiply charged.

The daughter ions are then accelerated through an accelleration lens 130 into a second stage TOF-type mass spectrometer 21 (MS2). The preferred form is a dual reflectron mass spectrometer 132, 134 having two reflectrons 136, 138 mounted at an end of a common vacuum chamber 140, opposite the inlet 142 from the collision region. A cryo pump 144 maintains a near vacuum in the chamber. The daul reflectron TOF second stage, in conjunction with the substantial reacceleration step after CID (depending upon m/z range of greatest interest), allow good resolution (~1000) to be obtained even given the relatively large translational energy releases due to Coulombic repulsion (possibly as high as 2-5 eV in certain instances, but likely smaller).

The deflector 122 in the collision region serves to deflect the daughter ions in two beams 146, 148 alternately to reflectrons 136, 138. Each beam is reflected to a CEMA detector 152, 154, which detect the arrival of daughter ions as time-of-flight spaced pulses. This structure and operation provide, in effect, two parallel reflection TOF mass spectrometers 132 (MS2) and 134 (MS2'). The deflector 122 is operated to provide a long duty cycle to mass spectrometer 132 (MS2) of over 99% and a short duty cycle to mass spectrometer 134 (MS2') of less than 1%.

Reflectron TOF stage 134 functions in a conventional manner. Ions leaving the collision region are gated by the deflector 122 through a selection slit, allowing primary ions to enter this TOF during "gate" periods of between 10 and 500 nsec (depending upon m/z range, accelerating voltage, and the desired trade-offs between resolution and sensitivity). Flight-times will generally be in the range of 5 to 500 μsec, allowing repetition rates in excess of 2 kHz. For the shorter gate widths, the expected parent ion beam intensities suggest that the CID of only one parent ion will generally be obtained. Thus, in this short gate period limit some product-correlated information could be obtained directly. (Detection efficiency will limit the potential utility of this approach.) Longer parent ion gates yield greater sensitivity, lower resolution, and a somewhat complicated product-correlation analysis. A hypothetical conventional TOF CID spectrum is shown in FIG. 3A. The best approach for obtaining higher sensitivity is based upon obtaining an autocorrelation spectrum as described below and shown in FIG. 3B.

Reflectron TOF stage 132 will continuously examine the CID products during the >99.5% of the time the ion beam is not deflected into TOF stage 134. Thus, this second TOF stage functions in a "free running" mode. Daughter ion m/z information is not strictly obtained in this approach. Nevertheless, the arrival of ions at detector 152 does provide information which may be correlated based upon the time intervals for arrival of ions arising from individual parent ions. This information is extracted by an autocorrelation analysis, described in more detail in the proceeding section "Data Acquisition and Analysis."

The resulting autocorrelation spectrum, such as that shown in FIG. 3B, is used most effectively to derive sibling relationships from the referential conventional mass spectrum (e.g., FIG. 3A) obtained as described above, or from a separate CID experiment. The two spectra thus make it possible to sort out sibling ions from several dissociation events and provide mass-to-charge ratios for the correlated ions to be used ion the reaction algorithms as discussed above to determine their charges and masses.

The primary attributes of this approach are greater sensitivity and precision of daughter ion m/z assignment. The possibility of greater precision arises from the fact that daughters from a single parent originate at a specific place and time (somewhat complicated due to the release of translational energy). This allows precise definition of the relative m/z of daughters from their centroid if any product can be identified from the reference spectrum. This method provides a unique approach for analysis of ion currents in which certain events are always related in time and allows resolution of otherwise different products of the same nominal m/z (and unresolved in the conventional spectrum).

b. Full Spectrum Array Detection Tandem Mass Spectrometer

Referring to FIG. 5, the second embodiment is an array detection tandem mass spectrometer 200. This system is arranged to provide mass spectrometric data which enables direct correlation of daughter ions to establish sibling relationships by providing position as well as time data. This is accomplished by using an array detector. It avoids the need to produce two spectra and to perform an autocorrelation analysis.

System 200 has a sample source and capillary (not shown) coupled to an ESI interface 13, as described above. It also uses $N_2$ preheating 202, differential vacuum 204 nozzle skimmer 206 and electrostatic quadrupole lens 208, generally as discussed above. The first stage mass spectrometer (MS1) is a double focusing mass spectrometer 210 comprising an electric sector 212 and a magnetic sector 214 which selects parent ions $[P^{Z+}]$ by energy state, regardless of mass-to-charge ratio. This mass spectrometer is based on a commercially available 10 kV instrument. A CEMA detector 216 can be selectably positioned in the parent ion path to detect the mass-to-charge ratio of the parent ions. A collision cell 218 is positioned in the ion path to dissociate the parent ions into daughter ions.

The daughter ions ($D^x$, $D^y$ and $D^z$) then enter a second stage velocity-correlated double-focusing spectrometer (MS2) 220 having an electric sector 222 and a magnetic sector 224. This type of mass spectrometer, which is double focusing for all CID products, is described by H. Matsuda in "A New Mass Spectrograph for the Analysis of Dissociation Fragments" *International J. Mass Spectrometry and Ion Processes,* Vol. 91, (1989), pp. 11-17.

The mass spectrometer has a linear array detector 226 similar in general structure to that described by Ouwerkerk but with a 2 meter by 2 cm array of 0.5 mm or narrower anodes with individual parallel readout circuitry for each anode. As used in the present invention, this mass spectrometer is of large size, having a 2 meter, 41 degree wedge magnet 229 and a 2.25 meter flat focal plane. It provides a full mass range (50-3000 at 10 kV) and a high resolution >4000 at its highest m/z and in both time and position (e.g., resolution 60 ns., 500 micrometer).

Referring to FIG. 6, the mass spectrometer 220 has a linear m/z scale (by anode position or channel) and a linear time scale in which sibling ion detections are temporally correlated by the relationships:

$$t_2=t_1\times(m_2/z_2)\times(z_1/m_1)$$

$$t_3=t_1\times(m_3/z_3)\times(z_1/m_1)$$

Any ion arriving at the detector 226 triggers a survey for sibling ions. Detected ions not meeting these relationships are presumably not sibling ions. Multiple surveys will run simultaneously for high CID ion currents. Except in the rare case in which two parent ions dissociate simultaneously, sibling assignment is unambiguously determined. This system can provide near real-time product correlated data which can be used as described above for charge state determination and spectral interpretation.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. An improved charge-separation mass spectrometry method for detecting dissociation of multiple-charged ions, the method comprising:

ionizing analyte molecules to form multiple-charged parent ions, each parent ion having a known mass and a known charge;

dissociating the parent ions into sets of fragments comprising a plurality of daughter ions, each daughter ion having a mass of at least one molecular weight and a charge of at least one, including a subset of two to four sibling ions resulting from the dissociation of one of the parent ions, at least one of the sibling ions having a charge greater than one;

detecting a mass-to-charge ratio for each of the daughter ions;

detecting temporal or temporo-spatial relationships among the daughter ions;

correlating the detected daughter ions in accordance with said relationships to determined which of the detected mass-to-charge ratios belong to the subset of sibling ions; and determining simultaneous values of the mass and charge of each of the sibling ions from their respective mass-to-charge ratios such that the charges determined for the sibling ions each substantially equal an integer and sum to the known charge of the parent ions.

2. A method according to claim 1 in which the detection steps include detecting a mass spectrum of the daughter ions and the correlation step include grouping peaks of the mass spectrum by fragmentation pathway.

3. A method according to claim 1 including selecting a single charge state of the parent ions for disocciation from among the multiple-charged parent ions.

4. A method according to claim 1 in which sibling ion detections are correlated by the relationship:

$$t_2-t_1=f(m/z),$$

where f(m/z) is a predetermined function of the mass-to-charge ratios of two detected daughter ions and the two daughters ions are detected at a time difference which equals $t_2-t_1$ in order to be sibling ions.

5. A method according to claim 1 in which the daughter ions are dispersed in accordance with a function of m/z and detected at times and positions that depend on mass-to-charge ratio m/z.

6. A method according to claim 5 in which sibling ion detections are correlated by the linear relationships:

$$t_2=t_1\times(m_2/z_2)\times(z_1/m_1)$$

$$t_3=t_1\times(m_3/z_3)\times(z_1/m_1)$$

where $t_3$, $t_2$ and $t_1$ are the times determined from the time differences detection of three detected daughter ions.

7. A method according to claim 1 in which sibling ion detections are correlated by comparison of a first autocorrelated time-of-flight mass spectrum of the daughter ions with a second mass spectrum of the daughter ions.

8. A method according to claim 1 in which sibling ion detections are correlated by comparison of a first autocorrelated mass spectrum of the daughter ions with second cross-correlated time-of-flight mass spectrum.

9. A method according to claim 1 in which sibling ion detections are correlated by comparison of an autocorrelated time-of-flight mass spectrum of the daughter ions with a cross-correlated time-of-flight mass spectrum of the daughter ions.

10. A method according to claim 1 in which the dissociating step is performed by dissociation of stable parent ions.

11. A method according to claim 1 in which the dissociating step is performed by collision dissociation of parent ions.

12. A method according to claim 11 in which the parent ions are collided with one of a gas, a surface, or an electron beam.

13. A method according to claim 1 in which the dissociating step is performed by irradiating the parent ions with a photon beam.

14. A method according to claim 1 in which the dissociating step is performed after selecting parent ions of a predetermined charge state.

15. A method according to claim 1 in which the simultaneous values of the mass and charge of each of the sibling ions are determined from their respective mass-to-charge ratios such that each of the following reaction conditions are met:

$$M^{Z+}\rightarrow m_a^{x+}+m_b \qquad \text{RX[1]}$$

$$M^{Z+}\rightarrow m_a^{x+}+y+ \qquad \text{Rx[2]}$$

$$M^{Z+}\rightarrow m_a^{x+}+m_b^{y+} \qquad \text{Rx[3]}$$

$$M^{Z+}\rightarrow m_a^{x+}+m_b^{y+}+m_c \qquad \text{Rx[4]}$$

$$M^{Z+}\rightarrow m_a^{x+}+m_b^{y+}+z+ \qquad \text{Rx[5]}$$

$$M^{Z+}\rightarrow m_a^{x+}+m_b^{y+}+m_c^{z+} \qquad \text{Rx[6]}$$

$$M^{Z+}\rightarrow m_a^{x+}+m_b^{y+}+m_c^{z+}+m_d \qquad \text{Rx[7]}$$

where $m_a+m_b+m_c=M$ $x+y+z=Z$, and $y+$ and $z+$ designate charge loss processes.

16. A method according to claim 1 in which the simultaneous values of the mass and charge of each of the sibling ions are determined from their respective mass-to-charge ratios such that at least one of the following reaction conditions are met:

$$M^{Z+} \rightarrow m_a^{x+} + m_b^{y+} \quad \text{Rx[3]}$$

$$M^{Z-} \rightarrow m_a^{x+} + m_b^{y+} + m_c \quad \text{Rx[4]}$$

$$M^{Z+} \rightarrow m_a^{x+} + m_b^{y+} + z+ \quad \text{Rx[5]}$$

$$M^{Z+} \rightarrow m_a^{x+} + m_b^{y+} + m_c^{z+} \quad \text{Rx[6]}$$

$$M^{Z+} \rightarrow m_a^{x+} + m_b^{y+} + m_c^{z+} + m_d \quad \text{Rx[7]}$$

where $m_a + m_b + m_c = M$ $x + y + z = Z$, and $z+$ designates charge loss processes.

17. A method according to claim 1 in which the simultaneous values of the mass and charge of each of the sibling ions are determined from their respective mass-to-charge ratios such that at least one of the following reaction conditions are met:

$$M^{Z+} + m_a^{x+} + m_b^{y+} \quad \text{Rx[3]}$$

$$M^{Z+} + m_a^{x+} + m_b^{y+} + m_c \quad \text{Rx[4]}$$

where $m_a + m_b + m_c = M$ $x + y = Z$, and x and y each exceed 1.

18. A method according to claim 1 in which the simultaneous values of the mass and charge of each of the sibling ions are determined from their respective mass-to-charge ratios such that at least one of the following reaction conditions are met:

$$M^{Z+} \rightarrow m_a^{x+} + m_b^{y+} + z+ \quad \text{Rx[5]}$$

$$M^{Z+} \rightarrow m_a^{x+} + m_b^{y+} + m_c^{z+} \quad \text{Rx[6]}$$

$$M^{Z+} \rightarrow m_a^{x+} + m_b^{y+} + m_c^{z+} + m_d \quad \text{Rx[7}$$

where $m_a + m_b + m_c = M$ $x + y + z = Z$, and $z+$ designates charge loss processes.

19. A method according to claim 1 in which the parent ions have at least four charges.

20. A method according to claim 1 in which the parent ions are ionized by electrospray ionization.

21. A method according to claim 1 in which the parent ions have a molecular weight over 3000.

22. A method according to claim 1 in which the parent ions are preselected by capillary electrophoresis, capillary isotachophoresis or liquid chromatography.

23. A method according to claim 1 in which at least two of the sibling ions are multiply charged.

24. A system for mass spectrometry of multiple-charged ions, the system comprising:

means for multiply charging analyte ions;

a dissociation cell for dissociating the multiple-charged ions to produce daughter fragments including a contemporaneous set of sibling ions for each dissociation event;

mass spectrometer means for temporally dispersing the daughter fragments in accordance with a predetermined function of mass-to-charge m/z;

detector means for detecting incidence of the daughter fragments including the sibling ions;

timing means for determining time intervals between the incidences of the detected daughter fragments at the detector means;

correlation means for correlation the incidences of at least the ionized daughter fragments to determine a set of sibling ions resulting from a single dissociation event and means for assigning simultaneous values of mass and charge to each of the sibling ions from their respective mass-to-charge ratios such that the assigned charges are substantially integer values and sum to the charge of the multiple-charged analyte ion.

25. A system according to claim 24 in which the means for assigning simultaneous values includes means for determining the simultaneous values of mass and charge to the sibling ions from the respective mass-to-charge ratios of the sibling ions such that each of the following reaction conditions are met:

$$M^{Z+} \rightarrow m_a^{x+} + m_b \quad \text{Rx[1]}$$

$$M^{Z+} \rightarrow m_a^{x+} + y+ \quad \text{Rx[2]}$$

$$M^{Z+} \rightarrow m_a^{x+} + m_b^{y+} \quad \text{Rx[3]}$$

$$M^{Z+} \rightarrow m_a^{x+} + m_b^{y+} + m_c \quad \text{Rx[4]}$$

$$M^{Z+} \rightarrow m_a^{x+} + m_b^{y+} + z+ \quad \text{Rx[5]}$$

$$M^{Z+} \rightarrow m_a^{x+} + m_b^{y+} + m_c^{z+} \quad \text{Rx[6]}$$

$$M^{Z+} \rightarrow m_z^{x+} + m_b^{y+} + m_c^{z+} + m_d \quad \text{Rx[7]}$$

where $m_a + m_b + m_c = M$ $x + y + z = Z$, and $y+$ and $z+$ designate charge loss processes.

26. A system according to claim 24 in which the means for assigning simultaneous values includes means for determining the simultaneous values of mass and charge to the sibling ions from the respective mass-to-charge ratios of the sibling ions such that at least one of the following reaction conditions are met:

$$M^{Z+} \rightarrow m_a^{x+} + m_b^{y+} \quad \text{Rx[3]}$$

$$M^{Z+} \rightarrow m_a^{x+} + m_b^{y+} + m_c \quad \text{Rx[4]}$$

$$M^{Z+} \rightarrow m_a^{x+} + m_b^{y+} + z+ \quad \text{Rx[5]}$$

$$M^{Z+} \rightarrow m_a^{x+} + m_b^{y+} + m_c^{z+} \quad \text{Rx[6]}$$

$$M^{Z+} \rightarrow m_a^{x+} + m_b^{y+} + m_c^{z+} + m_d \quad \text{Rx[7]}$$

where $m_a + m_b + m_c = M$ $x + y + z = Z$, and $z+$ designates charge loss processes.

27. A system according to claim 24 in which the means for assigning simultaneous values includes means for determining the simultaneous values of mass and charge to the sibling ions from the respective mass-to-charge ratios of the sibling ions such that at least one of the following reaction conditions are met:

$$M^{Z+} \rightarrow m_a^{x+} + m_b^{y+} \quad \text{Rx[3]}$$

$$M^{Z+} \rightarrow m_a^{x+} + m_b^{y+} + m_c \quad \text{Rx[4]}$$

where $m_a+m_b+m_c=M$
$x+y=Z$, and
x and y each exceed 1.

28. A system according to claim 24 in which the means for assigning simultaneous values includes means for determining the simultaneous values of mass and charge to the sibling ions from the respective mass-to-charge ratios of the sibling ions such that at least one of the following reaction conditions are met:

$$M^{Z+} \rightarrow m_a^{x+} + m_b^{y+} + z+ \quad \text{Rx[5]}$$

$$M^{Z+} \rightarrow m_a^{x+} + m_b^{y+} + m_c^{z+} \quad \text{Rx[6]}$$

$$M^{Z+} \rightarrow m_a^{x+} + m_b^{y+} + m_c^{z+} + m_d \quad \text{Rx[7]}$$

where
$m_a+m_b+m_c=M$
$x+y+z=Z$, and
$z+$ designates charge loss processes.

29. A system according to claim 24 in which the means for multiply-charging comprises means for electrospray ionization of an analyte solution to form said multiple-charged parent ions.

30. An array-type mass spectrometer, comprising:
- a mass spectrograph with a nonscanning magnet for temporally and spatially dispersing ions along a focal surface in accordance with a predetermined function of m/z;
- an array detector extending along the focal surface for detecting incidences of the ions at a plurality of positions therealong;
- a plurality of readout means for sensing the positions of detected incidences of ions on the focal surface;
- means for sensing times of detected incidences of ions on the focal surface and producing time measurements of sufficient precision to determine flight time differences of different ions; and
- means coupling the time and position sensing means for associating the times and positions of incidence of ions detected on the focal surface.

31. A mass spectrometer according to claim 30 in which the time sensing means includes clock means including a counter for timing the incidences of ions and memory means for storing clock readings corresponding to the incidences of ions on the focal surface.

32. A mass spectrometer according to claim 31 in which the clock means and memory means have a time resolution on the order of 100 ns.

33. A mass spectrometer according to claim 30 in which the position sensing means includes means for providing channel readouts corresponding to the positions of ion incidences on the focal surface.

34. A mass spectrometer according to claim 33 in which the position sensing means includes a plurality of discrete detector elements sized and spaced along the focal surface for detecting incidences of individual ions.

35. A mass spectrometer according to claim 34 in which the detector elements are sized and spaced at approximately 100 micrometer intervals.

36. A mass spectrometer according to claim 30 in which the mass spectrograph is arranged so that the predetermined function of m/z is a linear position function and the existence of a sibling relationship between two ions incident on the focal surface is substantially determined by the relationship $t_2=t_1\times(m_2/z_2)\times(z_1/m_1)$, where $t_1$ and $t_2$ are the times of arrival of two daughter ions arising from a single dissociation event.

37. A mass spectrometer according to claim 30 in which the focal surface is a plane.

38. An array detection system for mass spectrometry of multiple-charged ions, the system comprising:
- a dissociation cell for dissociating multiple-charged ions to produce a plurality of daughter fragments including a contemporaneous set of sibling ions for each dissociation event;
- a mass spectrograph for temporally and spatially dispersing ions along a focal surface in accordance with a predetermined function of mass-to-charge ratios m/z;
- an array detector extending along the focal surface for detecting incidences of the daughter fragments including said ions at a plurality of positions therealong;
- means for sensing the positions of the daughter fragments detected at the focal surface, the positions of the detected ions corresponding to their respective mass-to-charge ratios m/z;
- timing means for determining times of the incidences of detected daughter fragments at the detector means;
- means for associating the positions and times of detected ions at the focal surface;
- means for correlating the incidences of the detected ions to determine a set of sibling ions resulting from a single dissociation event.

39. A system according to claim 38 in which the correlating means includes means for equating the differences between detection time and a predetermined function of the mass-to-charge ratio f(m/z) for two detected ions, where the mass-to-charge ratio m/z is determined by the detected position and the predetermined function is determined by the instrument design in terms of instrument flight time from the dissociation cell to each position on the focal plane.

40. A dual time-of-flight mass spectrometer, comprising:
- a single source of analyte ions;
- means defining a first, time-of-flight mass spectrometer and a second mass spectrometer each positioned to receive ions from said source and having a detector for producing a spectrum of detected ions;
- gating means for selecting the mass spectrometer into which the ions are transmitted; and
- means for sensing time of incidence of the ions on the detector;
- the gating and timing means being operable with a first duty cycle to direct a sample of the ions into the first mass spectrometer to produce a time-of-flight means spectrum showing a temporal dispersion of the ions according to their respective times of flight and being operable with a second duty cycle much greater than the first duty cycle to direct an approximately-continuous stream of the ions into the second mass spectrometer to produce a substantially continuous output of detection times of detected ions.

41. A mass spectrometer according to claim 40 in which the time sensing means includes clock means including a counter for timing the incidences of ions and memory means for storing clock readings corresponding to the incidence of ions on the focal surface.

42. A mass spectrometer according to claim 41 in which the clock means and memory have a time resolution on the order of 100 ns.

43. A dual time-of-flight system for mass spectrometry of multiple-charged ions, the system comprising:

a dissociation cell for dissociating multiple-charged ions to produce a plurality of daughter fragments including a contemporaneous set of sibling ions for each dissociation event;

first mass spectrometer means for transmitting a first sampled portion of the ions from said source to a first detector to detect the ions as dispersed according to their respective times of flight;

first means for sensing times of incidence of the ions on the first detector, to determine the times of flight of ions in a mass spectrum thereof;

second mass spectrometer means for transmitting an approximately continuous stream of the ions from said source to a detector;

second means for sensing times of incidence of the ions on the second detector to generate a substantially continuous spectrum of the incidence times thereof;

means for generating an autocorrelation spectrum from the continuous spectrum, showing a difference of times of flight of the ions;

means for correlating the times of flight in the mass spectrum using the autocorrelation spectrum to determine a set of sibling ions resulting from a single dissociation event.

* * * * *